US011117375B2

(12) United States Patent
Watanabe

(10) Patent No.: US 11,117,375 B2
(45) Date of Patent: Sep. 14, 2021

(54) LIQUID EJECTING HEAD AND LIQUID EJECTING APPARATUS

(71) Applicant: SEIKO EPSON CORPORATION, Tokyo (JP)

(72) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/802,154

(22) Filed: Feb. 26, 2020

(65) Prior Publication Data

US 2020/0276815 A1 Sep. 3, 2020

(30) Foreign Application Priority Data

Feb. 28, 2019 (JP) ..... JP2019-035569

(51) Int. Cl.
*B41J 2/14* (2006.01)
*B41J 2/175* (2006.01)
*B41J 29/13* (2006.01)

(52) U.S. Cl.
CPC ..... *B41J 2/1433* (2013.01); *B41J 2/1752* (2013.01); *B41J 2/17509* (2013.01); (Continued)

(58) Field of Classification Search
CPC ..... B41J 2/1433; B41J 2/175; B41J 2/17509; B41J 2/17513; B41J 2/1752; B41J 2/17526; B41J 2/17596; B41J 29/13
See application file for complete search history.

(56) References Cited

U.S. PATENT DOCUMENTS 6,252,615 B1 * 6/2001 Yoshino ..... B41J 2/16523 347/36
6,402,289 B2 * 6/2002 Nitta ..... B41J 2/16532 347/30

(Continued)

FOREIGN PATENT DOCUMENTS

JP 2005-219229 8/2005
JP 2006-102986 4/2006

*Primary Examiner* — Anh T Vo
(74) *Attorney, Agent, or Firm* — Workman Nydegger

(57) ABSTRACT

A liquid ejecting head includes a first-valve-mechanism, a second-valve-mechanism, a nozzle plate, and a holder housing the first-valve-mechanisms and the second-valve-mechanisms. When a direction perpendicular to the nozzle plate is a first-direction, the nozzle plate extends in a second-direction and a third-direction. The first-valve-mechanism and the second-valve-mechanism arranged in the third-direction, with a space therebetween. The first-valve-mechanism includes a first-valve-element and a first-downstream-cover-member defining a first-downstream-chamber downstream of the first-valve-element. The second-valve-mechanism includes a second-valve-element and a second-downstream-cover-member defining a second-downstream-chamber downstream of the second-valve-element. The first-downstream-cover-member faces the second-downstream-cover-member. An interval between the nozzle plate and the first-valve-element is equal to an interval between the nozzle plate and the second-valve-element in the first-direction. The holder has no wall in an area of the space between the first-valve-mechanism and the second-valve-mechanism, the area overlapping the first-downstream-cover-member and the second-downstream-cover-member as viewed from the third-direction.

17 Claims, 7 Drawing Sheets

(52) U.S. Cl.
CPC ..... *B41J 2/17513* (2013.01); *B41J 2/17526* (2013.01); *B41J 2/17596* (2013.01); *B41J 29/13* (2013.01)

(56) References Cited

U.S. PATENT DOCUMENTS

| | | | | |
|---|---|---|---|---|
| 7,556,362 | B2 * | 7/2009 | Akahane | B41J 2/17596<br>347/40 |
| 2007/0188563 | A1 * | 8/2007 | Takahashi | B41J 2/17513<br>347/84 |
| 2010/0020138 | A1 * | 1/2010 | Yokouchi | B41J 2/17596<br>347/85 |

* cited by examiner

LIQUID EJECTING HEAD AND LIQUID EJECTING APPARATUS

The present application is based on, and claims priority from JP Application Serial Number 2019-035569, filed Feb. 28, 2019, the disclosure of which is hereby incorporated by reference herein in its entirety.

BACKGROUND

1. Technical Field

The present disclosure relates to a liquid ejecting head, such as an ink jet recording head, and a liquid ejecting apparatus including the liquid ejecting head.

2. Related Art

Liquid ejecting apparatuses are apparatuses that include a liquid ejecting head and that eject various kinds of liquid as droplets from the liquid ejecting head. Examples of the liquid ejecting apparatuses include image recording apparatuses such as ink jet printers and ink jet plotters. The liquid ejecting apparatuses have recently been used in various types of manufacturing apparatus by taking advantage of its feature capable of landing a very small amount of liquid accurately to a predetermined position. Examples include display manufacturing apparatuses that manufacture color filters of liquid crystal displays, electrode forming apparatuses that manufacture electrodes of organic electro luminescence (EL) displays, field emission displays (FEDs), or the like, and chip manufacturing apparatuses that manufacture biochips. Liquid ejecting heads for image recording apparatuses eject liquid containing a coloring material. Color-material ejecting heads for display manufacturing apparatuses eject liquid containing a coloring material, such as red (R), green (G), or blue (B). Electrode-material ejecting heads for electrode forming apparatuses eject liquid containing an electrode material. Bioorganic-material ejecting heads eject liquid containing a bioorganic material.

Some liquid ejecting heads include a valve mechanism including a valve element that opens and closes a channel from a liquid supply member to the nozzles of the liquid ejecting heads. For example, a liquid ejecting apparatus disclosed in JP-A-2006-102986 includes a valve unit, which is also referred to as "negative-pressure regulating valve", in a carriage, the valve unit being covered with a carriage cover. The valve unit is generally provided for each liquid type (for example, ink color). A plurality of valve units are provided in the direction in which the nozzles rows are arranged in correspondence with the nozzles rows. The interior of the carriage cover is partitioned by partition walls into spaces in which the individual valve units are housed. In other words, a wall is provided between adjacent valve units inside the carriage cover.

The above configuration has a wall between the valve units, which increases the size of the liquid ejecting head in the direction in which the valve units are arranged, and as a result, the liquid ejecting apparatus including the liquid ejecting head also increases in size.

SUMMARY

A liquid ejecting head according to a first aspect of the present disclosure includes a valve mechanism including a valve element, a nozzle plate, and a holder and opens and closes the valve element in accordance with a pressure in a channel downstream from the valve element. The nozzle plate includes a plurality of nozzles that eject liquid supplied from the valve mechanism. The holder has a housing space housing a plurality of valve mechanisms. Each of the plurality of valve mechanisms includes the valve element and opens and closes the valve element in accordance with the pressure in the channel downstream from the valve element. The plurality of nozzles are arranged in the nozzle plate along a second direction and a third direction. A first direction is perpendicular to the nozzle plate. The first direction, the second direction, and the third direction are orthogonal to each other. The plurality of valve mechanisms include a first valve mechanism and a second valve mechanism arranged in the third direction with a space between the first valve mechanism and the second valve mechanism. The first valve mechanism and the second valve mechanism each include a downstream cover member defining part of a downstream chamber downstream from the valve element. The downstream cover members is disposed so as to face each other and is displaced in accordance with a pressure in the downstream chamber. The interval between the nozzle plate and the valve element of the first valve mechanism and the interval between the nozzle plate and the valve element of the second valve mechanism are equal to each other in the first direction. The holder has no wall in an area of the space between the first valve mechanism and the second valve mechanism, the area overlapping the downstream cover member as viewed from the third direction.

(First Configuration)

Since the liquid ejecting head according to the first aspect of the present disclosure has no wall between the first valve mechanism and the second valve mechanism, the first and second valve mechanisms can be disposed close to each other, so that the liquid ejecting head can be reduced in size. Furthermore, since the intervals between the nozzles plate and the valve element of the valve mechanisms are equal, the supply pressures of the liquid supplied downstream from the valve elements, that is, to the nozzles, are equal between the valve mechanisms. This allows reducing variations in ejection characteristics between the nozzle rows.

A liquid ejecting head according to a second aspect of the present disclosure includes a valve mechanism and a nozzle plate. The valve mechanism includes a valve element and opens and closes the valve element in accordance with a pressure in a channel downstream from the valve element. The nozzle plate includes a plurality of nozzles that eject liquid supplied from the valve mechanism. The plurality of nozzles are arranged in the nozzle plate along a second direction and a third direction. A first direction is perpendicular to the nozzle plate. The first direction, the second direction, and the third direction are orthogonal to each other. The valve mechanism includes a first valve mechanism and a second valve mechanism arranged in the third direction with a space between the first valve mechanism and the second mechanism. The first valve mechanism and the second valve mechanism each include a downstream cover member defining part of a downstream chamber downstream from the valve element. The downstream cover members is disposed so as to face each other and is displaced in accordance with a pressure in the downstream chamber. The interval between the nozzle plate and the valve element of the first valve mechanism and the interval between the nozzle plate and the valve element of the second valve mechanism are equal to each other in the first direction. The downstream cover member of the first valve mechanism and the downstream cover member of the second valve mechanism are disposed at different positions in the third direction and overlap at least partially as viewed from the second direction.

(Second Configuration)

In the liquid ejecting head according to the second aspect of the present disclosure, the downstream cover members at the opposing surfaces of the first valve mechanism and the second valve mechanism are disposed at different positions in the third direction and overlap at least partially as viewed from the second direction. This allows the first and second valve mechanisms to be disposed close to each other, reducing the size of the liquid ejecting head. Furthermore, since the intervals between the nozzles plate and the valve element of the valve mechanisms are equal, the supply pressures of the liquid supplied downstream from the valve elements, that is, to the nozzles, are equal between the valve mechanisms. This allows reducing variations in ejection characteristics between the nozzle rows.

The liquid ejecting head with the first or second configuration may further include a plurality of sets of liquid introducing portions arranged in the third direction. The liquid introducing portions are arranged in the second direction in which the plurality of nozzles form a nozzle row. The liquid introducing portions introduce liquid from the valve mechanisms into the nozzles. The interval between the liquid introducing portions adjacent in the second direction may be larger than the interval between the liquid introducing portions adjacent in the third direction.

(Third Configuration)

Since this configuration allows the interval between the valve mechanisms coupled to the liquid introducing portions to be close to each other in the third direction, the size of the liquid ejecting head can be reduced, and the interval between the valve elements in the second direction can be increased, so that the pressure areas of the downstream cover members corresponding to the individual valve elements can be increased. This achieves both of the size reduction of the liquid ejecting head and the uniformity of the ejection characteristics of the nozzles.

A liquid ejecting head according to a third aspect of the present disclosure includes a nozzle plate and a plurality of liquid introducing portions. The nozzle plate includes a plurality of nozzles that eject liquid. The plurality of liquid introducing portions are configured to introduce liquid into the nozzles. The plurality of nozzles are arranged along a second direction orthogonal to a first direction perpendicular to the nozzle plate to form a nozzle row. A plurality of the nozzle rows are arranged along a third direction orthogonal to the first direction and the second direction. A plurality of sets of the plurality of liquid introducing portions arranged in the second direction are arranged along the third direction. The interval between the liquid introducing portions adjacent in the second direction is larger than the interval between the liquid introducing portions adjacent in the third direction.

(Fourth Configuration)

This configuration allows size reduction of the liquid ejecting head by decreasing the interval between the liquid introducing portions in the third direction. Furthermore, in the configuration in which liquid is supplied from the liquid introducing portions to the same nozzle row, by increasing the interval between the liquid introducing portions in the second direction, the supply pressures to the nozzles of the nozzle row can be made more uniform. This allows the ejection characteristics of the nozzles to be made uniform.

The liquid ejecting head with the fourth configuration may further include a plurality of valve mechanisms each including a valve element. The valve mechanisms each opens and closes the valve element in accordance with a pressure in a channel downstream from the valve element to control supply of liquid to the liquid introducing portion. The plurality of valve mechanisms may be individually coupled to the sets of liquid introducing portions and arranged in the third direction. The interval between the nozzle plate and the valve element of the first valve mechanism and the interval between the nozzle plate and the valve element of the second valve mechanism may be equal to each other in the first direction. (Fifth Configuration)

Since this configuration allows the interval between the valve mechanisms coupled to the liquid introducing portions to be close to each other in the third direction, the size of the liquid ejecting head can be reduced, and the interval between the valve elements in the second direction can be increased, so that the pressure areas of the downstream cover members corresponding to the individual valve elements can be increased. This achieves both of the size reduction of the liquid ejecting head and the uniformity of the ejection characteristics of the nozzles.

In any one of the third to fifth configurations, the liquid introducing portions constituting the set of liquid introducing portions may be smaller in number than the set of liquid introducing portions arranged in the third direction. The interval between the liquid introducing portions adjacent in the second direction may be larger the interval between the liquid introducing portions adjacent in the third direction.

(Sixth Configuration)

This configuration allows size reduction of the liquid ejecting head and uniformity of supply pressures to the nozzles by decreasing the interval between the liquid introducing portions even with a configuration in which the number of the liquid introducing portions in the third direction is large.

The liquid ejecting head with any one of the second to sixth configurations may further include a holder having a housing space housing a plurality of valve mechanisms. Each of the plurality of valve mechanisms includes the valve element and opens and closes the valve element in accordance with the pressure in the channel downstream from the valve element. The holder may have no wall in an area of the space between the first valve mechanism and the second valve mechanism, the area overlapping the downstream cover member as viewed from the third direction. (Seventh Configuration)

Since this configuration has no wall between the first valve mechanism and the second valve mechanism, the first and second valve mechanisms can be disposed close to each other, allowing size reduction of the liquid ejecting head.

A liquid ejecting apparatus according to a fourth aspect of the present disclosure includes the liquid ejecting head with any one of the above configurations.

(Eighth Configuration)

This configuration allows size reduction of the liquid ejecting apparatus because the liquid ejecting apparatus includes a miniaturized liquid ejecting head.

DESCRIPTION OF EXEMPLARY EMBODIMENTS

Embodiments of the present disclosure will be described hereinbelow with reference to the attached drawings. In the embodiments described below, various limitations are made as preferred specific examples. However, it is to be understood that the scope of the present disclosure is not limited to these embodiments unless specifically stated to limit the present disclosure in the following description. In the following description, an ink jet recording apparatus equipped with an ink jet recording head, which is a type of liquid ejecting head, is used as an example of the liquid ejecting apparatus of the present disclosure.

Figure 1:
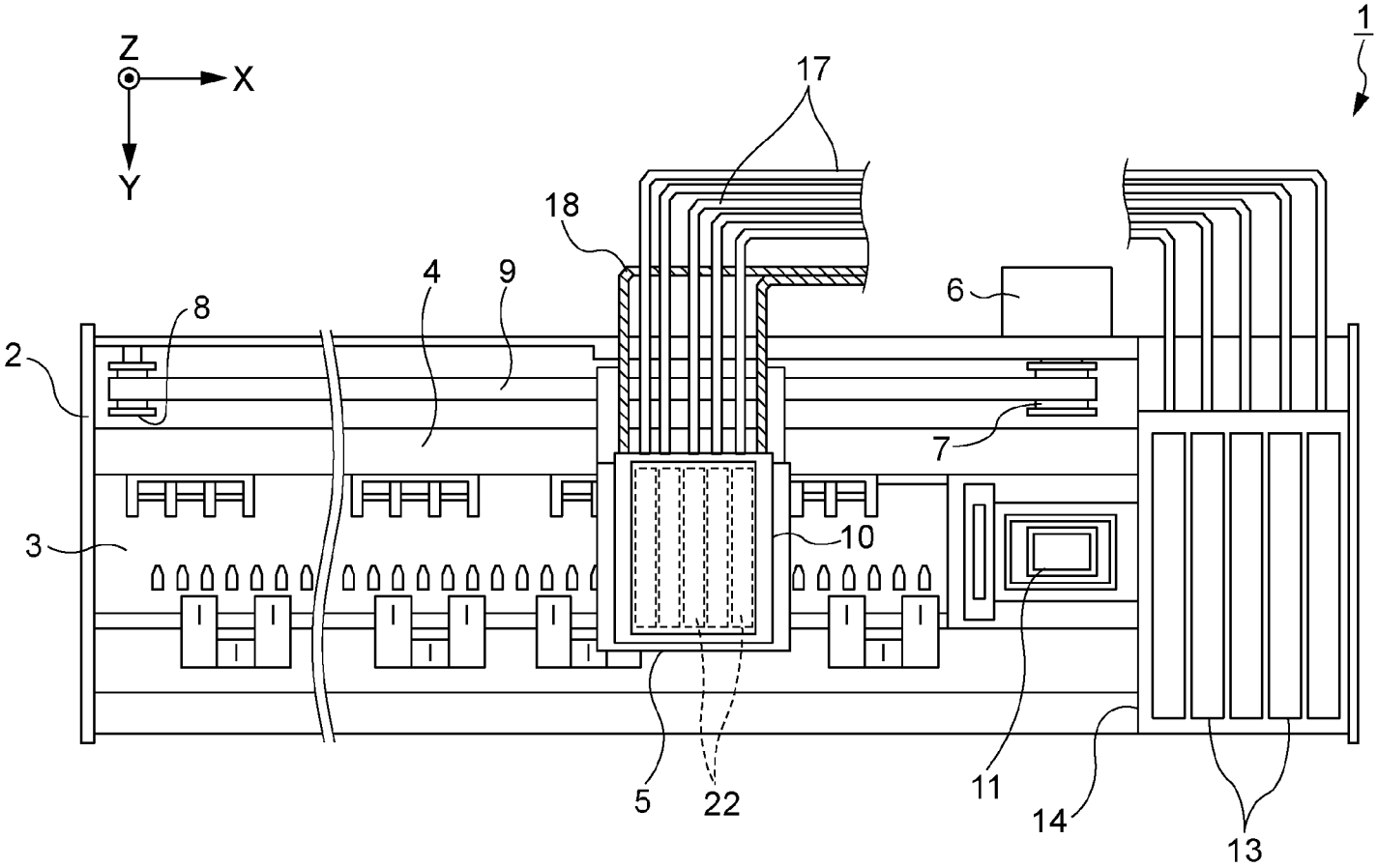
FIG. 1 is a plan view of a liquid ejecting apparatus according to an embodiment illustrating the configuration thereof.

FIG. 1 is a plan view of a liquid ejecting apparatus 1 according to an embodiment illustrating the configuration thereof. The liquid ejecting apparatus 1 of the present embodiment is an apparatus that ejects liquid ink (a kind of liquid in the present disclosure) from a liquid ejecting head 10 (see FIG. 2) onto the surface of a recording sheet, cloth, resin film, or another medium (a liquid landing target, not illustrated) to record an image, text, or the like. The liquid ejecting apparatus 1 includes a frame 2 and a platen 3 that supports the medium during printing and transports the medium onto the platen 3 using a transporting mechanism (not illustrated). The liquid ejecting apparatus 1 includes a guide 4 parallel to the platen 3 in the frame 2. The guide 4 movably supports a carriage 5 housing the liquid ejecting head 10. The carriage 5 is configured to be moved along the guide 4, by a carriage moving mechanism (not illustrated), back and forth in a main scanning direction crossing the medium transporting direction. The carriage moving mechanism includes a pulse motor 6, a drive pulley 7 rotated by driving of the pulse motor 6, an idle pulley 8 disposed on the opposite side from the drive pulley 7 in the frame 2, and a timing belt 9 stretched between the drive pulley 7 and the idle pulley 8.

The liquid ejecting apparatus 1 of the present embodiment performs a recording operation by ejecting ink from the nozzles 47 of the liquid ejecting head 10 (see FIG. 4) toward the medium while moving the carriage 5 back and forth relative to the medium. In the following description, of the X direction, the Y direction, and the Z direction orthogonal to one another, the Y direction is the medium transporting direction, that is, the direction in which the medium and the liquid ejecting head 10 move relative to each other (corresponding to a second direction in the present disclosure), the X direction is a direction orthogonal to the transporting direction (corresponding to a third direction in the present disclosure), and the Z direction is a direction perpendicular to the X-Y plane (corresponding to a first direction in the present disclosure).

A cartridge holder 14 that detachably holds ink cartridges 13, which are a kind of liquid storage in which liquid is stored, is provided at one side of the frame 2. The ink cartridges 13 are configured to be supplied with air from an air pump (not illustrated) and to supply the ink in the ink cartridges 13 to the liquid ejecting head 10 through ink supply tubes 17 by being pressed by the pressurized air. The ink fed from the ink cartridges 13 through the ink supply tubes 17 is first introduced into valve units 22 (a kind of valve mechanism in the present disclosure) mounted at the carriage 5. The ink introduced into the valve units 22 is regulated to a fixed supply pressure, as will be described below, and is supplied to ink channels in the liquid ejecting head 10. The liquid storage is not limited to the above example and may have various configurations, such as a cartridge type, a package type, and a tank type. The present disclosure may use a configuration in which the ink is circulated between the liquid storages and the liquid ejecting head 10 by driving a pump.

The ink supply tubes 17 are flexible hollow members made of, for example, synthetic resin, in each of which an ink channel corresponding to one of the ink cartridges 13 is formed. Furthermore, flexible flat cables (FFCs) 18 that transmit driving signals or the like from a control unit (not illustrated) of the liquid ejecting apparatus 1 main body to the liquid ejecting head 10 are wired between the liquid ejecting apparatus 1 main body and the liquid ejecting head 10.

Inside the frame 2, a capping mechanism 11 that seals a nozzle surface in which the nozzles 47 of the liquid ejecting head 10 are formed is disposed at a home position on one side of the moving range of the liquid ejecting head 10 (on the cartridge holder 14 side in the present embodiment). The capping mechanism 11 seals the nozzle surface of the liquid ejecting head 10 in a standby state at the home position with a cap to prevent the solvent in the ink from evaporating through the nozzles 47. Furthermore, the capping mechanism 11 is configured to perform a cleaning operation for forcibly sucking the ink or air bubbles through the nozzles 47 by producing negative pressure in the sealed space using a suction unit, such as a suction pump, with the nozzle surface of the liquid ejecting head 10 sealed.

Figure 2:
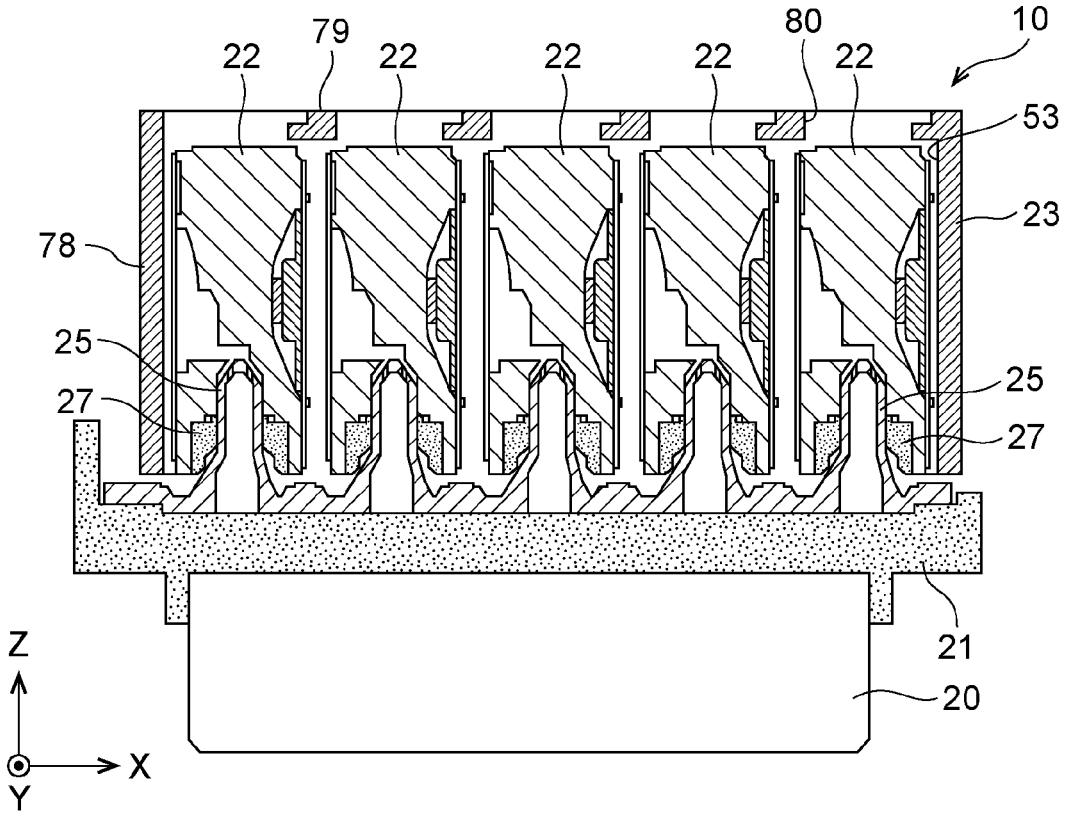
FIG. 2 is a cross-sectional view of a liquid ejecting head according to an embodiment illustrating the configuration thereof.
Figure 3:
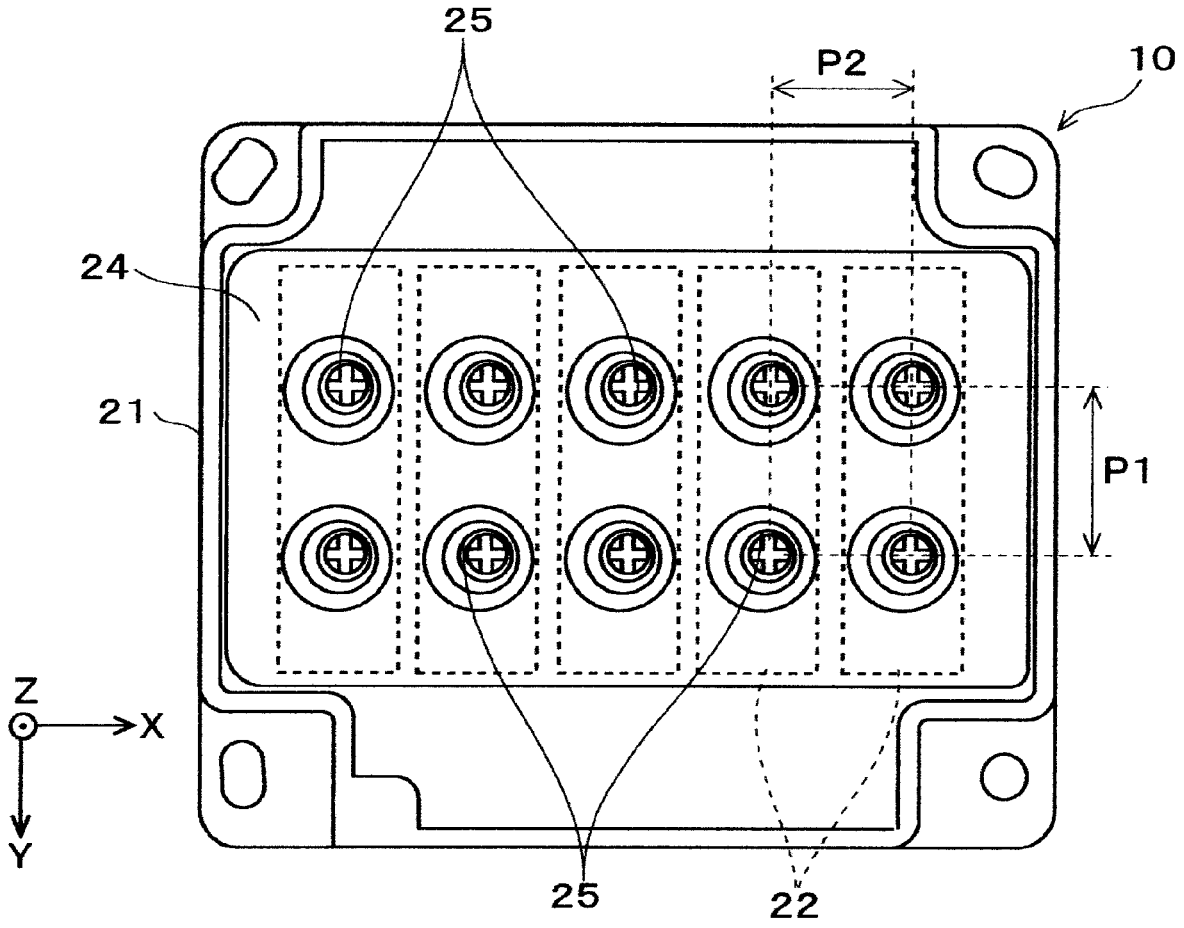
FIG. 3 is a plan view of the liquid ejecting head according to the embodiment illustrating the configuration thereof.

Next, the configuration of the liquid ejecting head 10 in the present embodiment will be described. FIG. 2 is a cross-sectional view of the liquid ejecting head 10. FIG. 3 is a plan view of the liquid ejecting head 10. In FIG. 3, the valve units 22 and a holder 23 are omitted, and the area in which each valve unit 22 is disposed is indicated by a broken line. The liquid ejecting head 10 in the present embodiment includes a head main body 20, a liquid introducing member 21, the valve units 22, and the holder 23.

The liquid introducing member 21 has ink introducing channels (not illustrated) therein that introduce the ink supplied from the valve units 22 to the head main body 20 are provided. As illustrated in FIG. 3, a mount area 24 for the valve units 22 is partitioned on the upper surface of the liquid introducing member 21. The mount area 24 has upstream openings of the ink introducing channels. The openings are individually fitted with a plurality of liquid introducing needles 25 (a kind of liquid introducing portion in the present disclosure), with a filter (not illustrated) disposed therebetween. In the present embodiment, multiple liquid introducing needles 25 are disposed along the Y direction in the ab in which each valve unit 22 is disposed. Multiple sets of liquid introducing needles 25 arranged in the Y direction are disposed along the X direction in correspondence with the individual areas in which the valve units 22 are disposed. In the present embodiment, five sets of two liquid introducing needles 25 arranged along the Y direction are disposed in the X direction. Thus, ten liquid introducing needles 25 in total are disposed in the mount area 24.

These liquid introducing needles 25 are inserted into liquid flow out portions 27 provided at the lower surfaces of the valve units 22 mounted to the mount area 24 and introduce the ink supplied from the valve units 22 to the head main body 20. Each liquid introducing needle 25 is a hollow needle and has an inlet hole at the end. The bottom of the liquid introducing needle 25 increases in diameter in a splay shape from the end toward the lower opening. The liquid introducing needles 25 may introduce the ink not with such a configuration using the liquid introducing needles 25 but with a so-called foam configuration in which the ink inlet of the liquid introducing member 21 is provided with a porous material such as nonwoven cloth or sponge, and the liquid flow out portions 27 of the valve units 22 are also provided with a similar porous material so as to pass and receive the liquid by the capillary action of the porous materials in contact with each other.

Thus, in disposing the liquid introducing needles 25 in the mount area 24, setting the interval between the liquid introducing needles 25 adjacent in the Y direction larger than the interval between the liquid introducing needles 25 adjacent in the X direction so that the liquid introducing needles 25 are close to each other in the X direction allows reducing the size of the liquid ejecting head 10. In a configuration in which ink is supplied from the liquid introducing portions 25 to the same or a plurality of nozzle rows 48, increasing the interval between the liquid introducing needles 25 in the Y direction allows uniformizing the supply pressure to the nozzles 47 constituting the nozzle row 48. This allows uniformizing the ejection characteristics of the nozzles 47. Also in a configuration in which the number of liquid introducing needles 25 arranged in the X direction is large, that is, the number of valve units 22 arranged in the X direction is large, setting the interval between the liquid introducing needles 25 adjacent in the Y direction to be larger than the interval between the liquid introducing needles 25 adjacent in the X direction allows reducing the size of the liquid ejecting head 10 by decreasing the interval between the liquid introducing needles 25 adjacent in the X direction while uniformizing the supply pressure to the nozzles 47.

Figure 4:
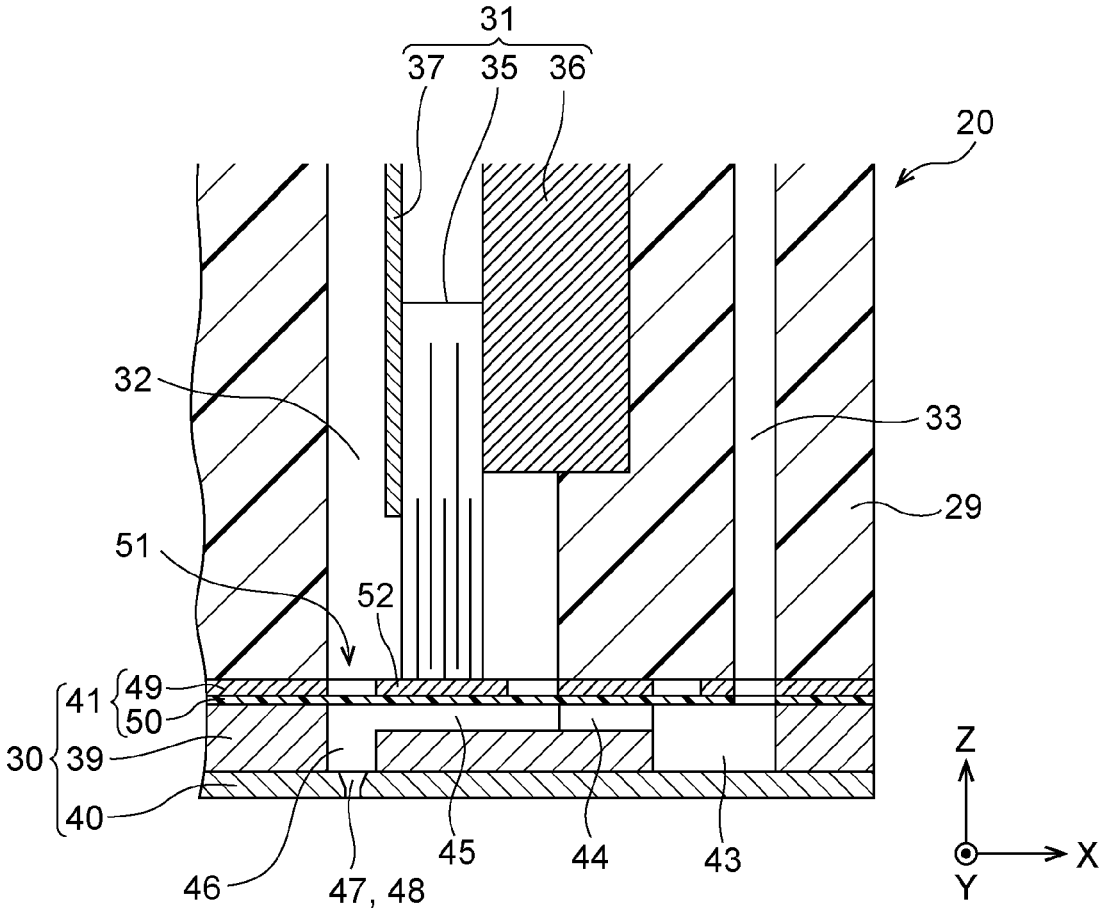
FIG. 4 is a cross-sectional view of a head main body illustrating the configuration thereof.
Figure 5:
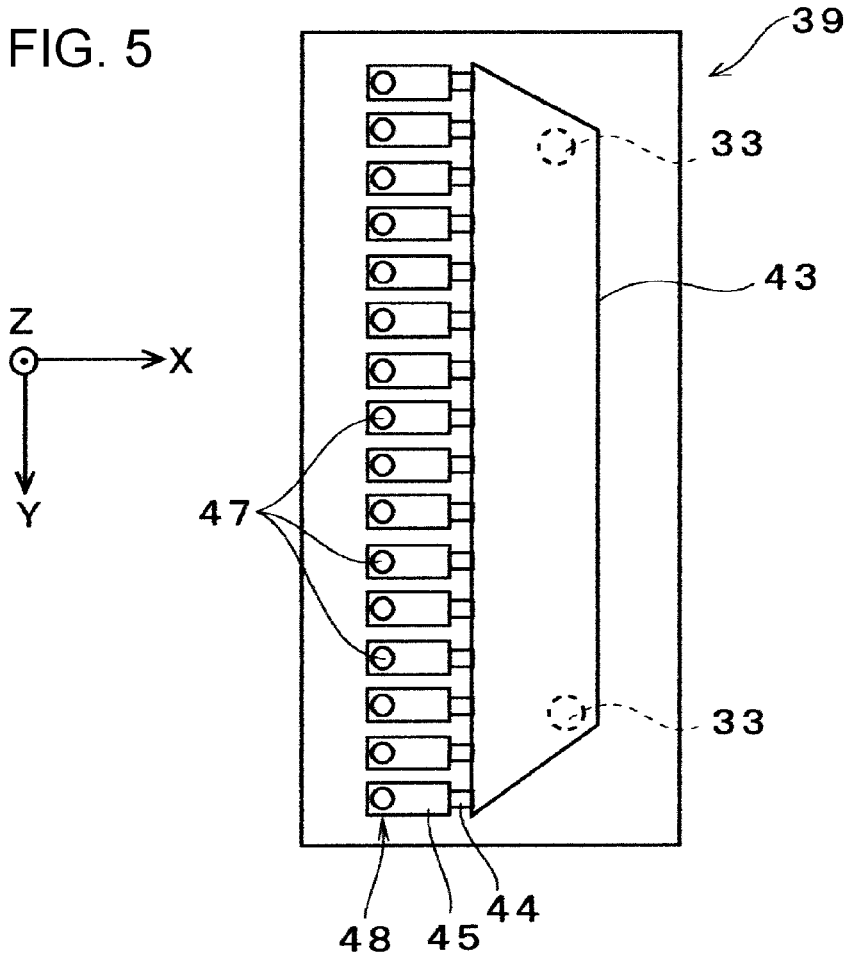
FIG. 5 is a schematic plan view of a channel substrate.

FIG. 4 is a cross-sectional view of the head main body 20 illustrating the configuration thereof. FIG. 5 is a schematic plan view of a channel substrate 39. The head main body 20 in the present embodiment includes a head case 29 and a channel unit 30. The head case 29 is a synthetic resin member in which a housing 32 housing an actuator unit 31 and inlet channels 33 that introduce the ink supplied from the liquid introducing member 21 into the channel unit 30 are formed. The channel unit 30 is joined to the lower surface of the head case 29 in the Z direction. As illustrated in FIG. 2, the liquid introducing member 21 is laminated on the upper surface of the head case 29 in the Z direction.

The actuator unit 31 includes a piezoelectric device 35 that functions as a driving element (also referred to as a pressure generating element or an actuator), a fixing plate 36 to which the piezoelectric device 35 is joined, and a wiring member 37 that supplies a driving signal to the piezoelectric device 35. The piezoelectric device 35 in the present embodiment is a what-is-called piezoelectric device in a longitudinal vibration mode. When a driving signal is supplied, the piezoelectric device 35 is displaced, that is, extends and contracts, in a direction intersecting the direction in which the piezoelectric substance and the electrode are layered. An end of the piezoelectric device 35 is joined to a diaphragm 51 of the channel unit 30.

The channel unit 30 has a configuration in which a nozzle plate 40 is joined to one surface of a channel substrate 39 in the Z direction and in which a vibration plate 41 is joined to the other surface of the channel substrate 39 in the Z direction. The channel unit 30 includes a common liquid chamber 43, individual supply channels 44, pressure chambers 45, nozzle communication ports 46, and the nozzles 47. In the present embodiment, the nozzles 47 are formed in the nozzle plate 40, and the common liquid chamber 43, individual supply channels 44, the pressure chambers 45, and the nozzle communication ports 46 are formed in the channel substrate 39. The channel substrate 39 may be a stack of multiple substrates. The pressure chambers 45 may be disposed in another substrate different from the substrate of the common liquid chamber 43, the individual supply channels 44, and the nozzle communication ports 46.

The nozzle plate 40 is a plate in which the plurality of nozzles 47 are disposed along the Y direction with regular pitches and is made of, for example, a silicon single crystal plate or a metal plate, such as a stainless steel plate. The nozzle plate 40 includes a plurality of nozzle rows 48 (nozzle groups) including a plurality of nozzles 47 arranged in the Y direction. The plurality of nozzle rows 48 are disposed in the nozzle plate 40 according to the kind (that is, color), the number, and so on of the ink used in the liquid ejecting apparatus 1.

An example of the channel substrate 39 is a silicon single crystal substrate. The channel substrate 39 includes the plurality of pressure chambers 45 arranged in in the Y direction in correspondence with the nozzles 47. As illustrated in FIG. 5, the channel substrate 39 has the common liquid chamber 43 at an area offset from the pressure chambers 45 in the X direction. The common liquid chamber 43 and the pressure chambers 45 communicate through the individual supply channels 44 provided for the corresponding pressure chambers 45. The common liquid chamber 43 is a liquid chamber shared by the plurality of pressure chambers 45 and stores ink supplied through the inlet channels 33 of the head case 29. In the present embodiment, the head case 29 includes two inlet channels 33 communicating with the two flow out portions 27 of the valve units 22 in correspondence with the common liquid chamber 43. These inlet channels 33 communicate with the opposite ends of the common liquid chamber 43 in the Y direction. This allows the ink to be introduced into the common liquid chamber 43 through the opposite ends in the Y direction, allowing more uniformizing the supply pressure of the ink from the common liquid chamber 43 to the pressure chambers 45 than, for example, a configuration in which the ink is introduced to the common liquid chamber 43 through one inlet channel 33. This suppresses variations in the ejection characteristics of the ink ejected from the nozzles 47, such as the amount and the splashing speed of the ink.

The cross-sectional areas of the individual supply channels 44 in the Y-Z plane are set smaller than the cross-sectional areas of the pressure chambers 45 in the Y-Z plane. The pressure chambers 45 each have the nozzle communication port 46 passing through the channel substrate 39 in the Z direction, which is the thickness direction, on the opposite side from the individual supply channel 44. The nozzle communication ports 46 are channels that communicate the pressure chambers 45 and the nozzles 47 of the nozzle plate 40 one to one. The pressure chambers 45, the individual supply channels 44, and the nozzle communication ports 46 in the channel substrate 39 are formed by, for example, anisotropic etching.

The vibration plate 41 has a double structure in which a support plate 49 and an elastic film 50 are laminated. In the present embodiment, the support plate 49 is a stainless plate, which is a kind of metal plate. The vibration plate 41 is a composite plate in which the elastic film 50, which is a resin film, is joined to the surface of the support plate 49. The vibration plate 41 includes diaphragms 51 that change the capacities of the pressure chambers 45. The diaphragms 51 are produced by removing part of the support plate 49 by etching or the like. In other words, the diaphragms 51 are formed by removing portions of the support plate 49 around insular portions 52 to which the end faces of the piezoelectric devices 35 are to be joined, so that only the elastic film 50 remains. Since the end face of each piezoelectric device 35 is joined to the insular portion 52, extension and contraction of the piezoelectric device 35 cause the diaphragm 51 to be displaced, thereby changing the capacity of the pressure chamber 45. The capacity change causes the ink in the pressure chamber 45 to change in pressure (in other words, pressure change).

In the liquid ejecting head 10 with the above configuration, the piezoelectric device 35 is driven according to a driving signal applied through the wiring member 37, with the channel from the common liquid chamber 43 through the pressure chamber 45 to the nozzle 47 filled with the ink in the pressure chamber 45, to cause the ink to change in pressure, and the pressure change causes the ink to be ejected from the predetermined nozzle 47.

Figure 6:
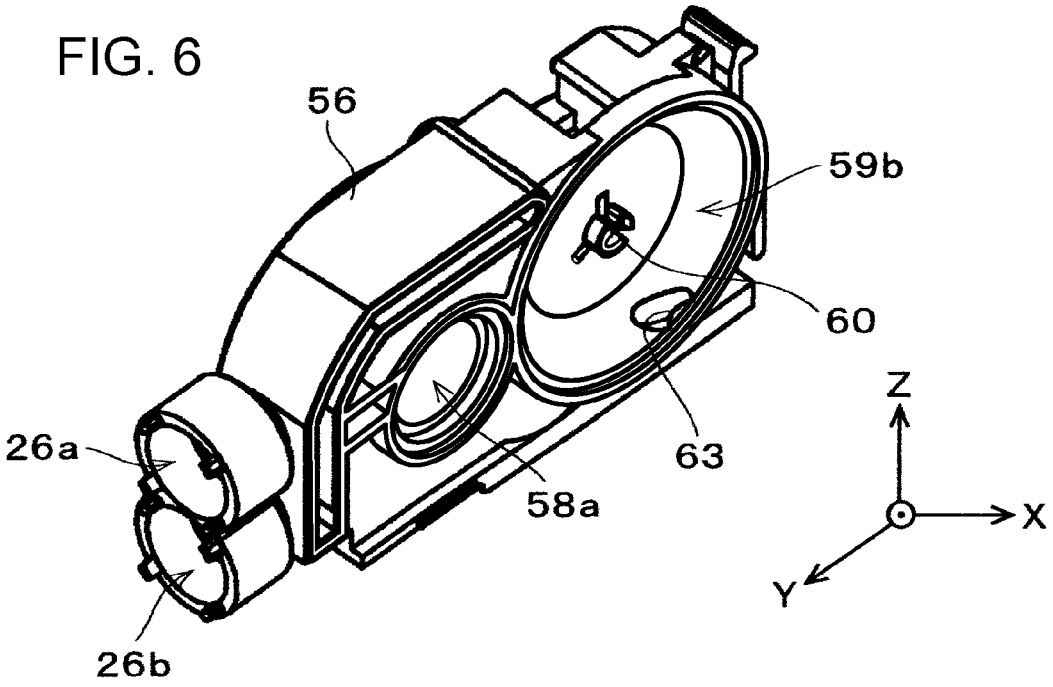
FIG. 6 is a perspective view of each valve unit illustrating the configuration thereof.
Figure 7:
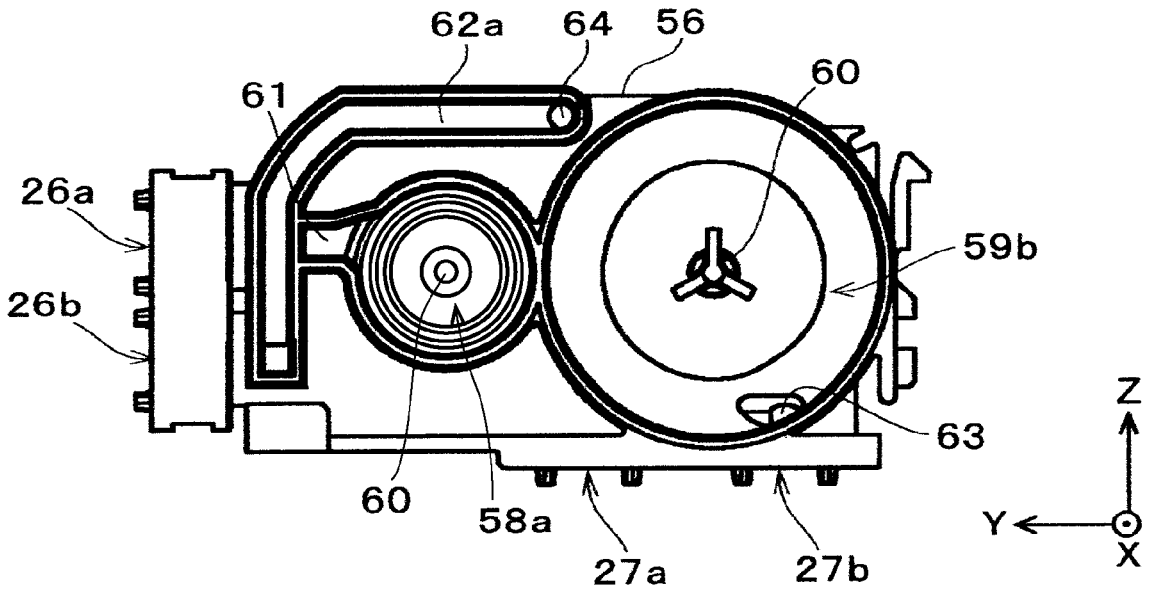
FIG. 7 is a right side view of the valve unit.
Figure 8:
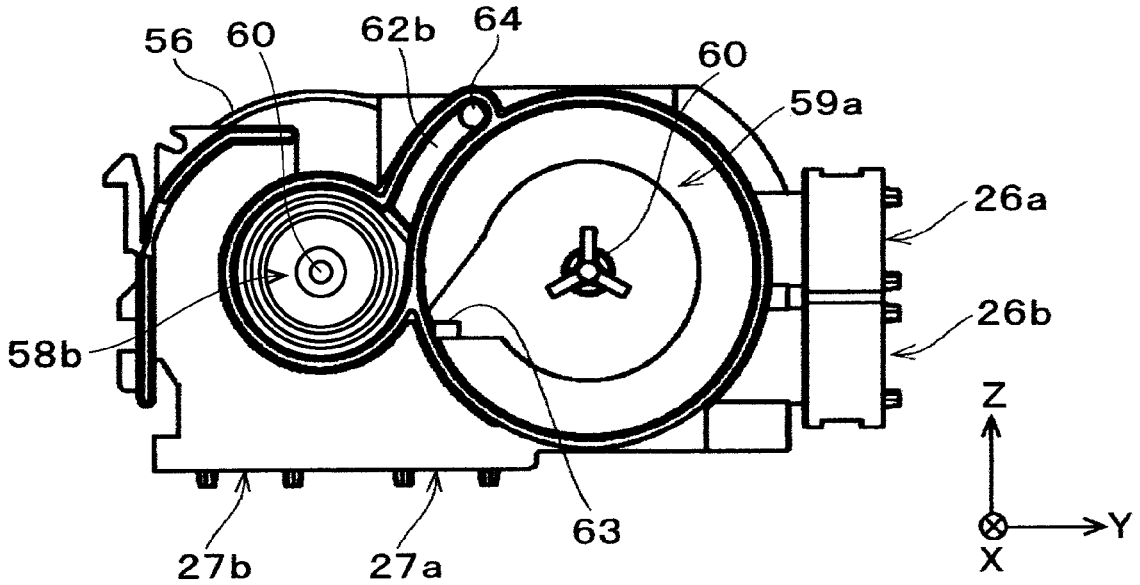
FIG. 8 is a left side view of the valve unit.
Figure 9:
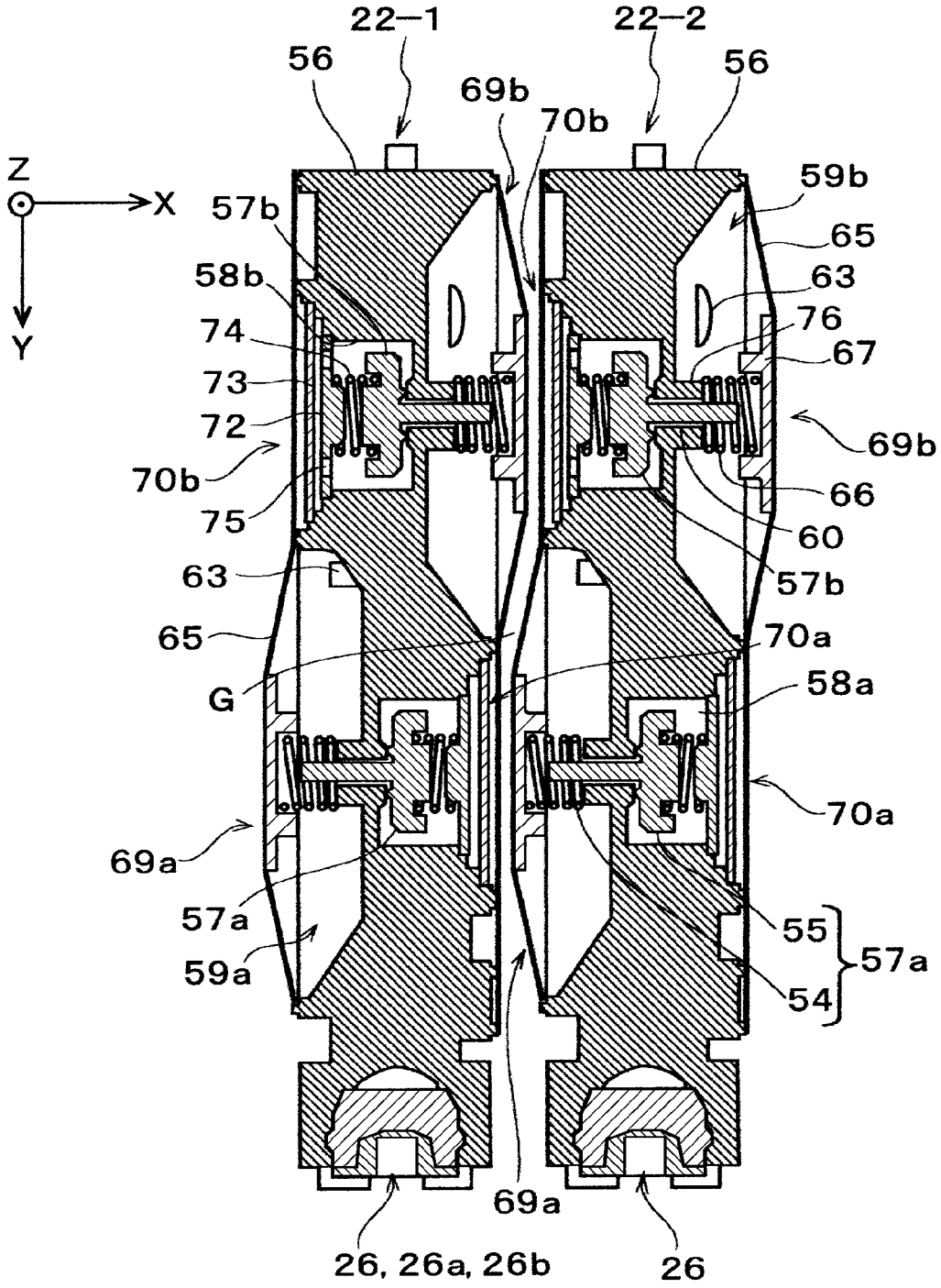
FIG. 9 is a cross-sectional view of two adjacent valve units illustrating the positional relationship therebetween.

Next, the valve units 22 will be described. FIG. 6 is a perspective view of each valve unit 22. FIG. 7 is a right side view of the valve unit 22. FIG. 8 is a left side view of the valve unit 22. FIG. 9 is a cross-sectional view of two adjacent valve units 22 of the plurality of valve units 22 disposed in the mount area 24 of the liquid introducing member 21 in the direction orthogonal to the Z direction, illustrating the positional relationship therebetween. FIGS. 6 to 8 mainly illustrate the configuration of a unit main body 56, in which a pressure regulation valve 57, a flexible film 65, and so on are omitted. In FIG. 9, one of the two valve units 22 adjacent in the X direction disposed on one side (the left in FIG. 9) is referred to as "first valve unit 22-1" as appropriate (corresponding to a first valve mechanism in the present disclosure), and the valve unit 22 disposed on the other side in the X direction (the right in FIG. 9) is referred to as "second valve unit 22-2" (corresponding to a second valve mechanism in the present disclosure. Accordingly, in a configuration in which three or more valve units 22 are mounted in the mount area 24 of the liquid introducing member 21, the arrangement of valve units 22 adjacent in the X direction is the same as that of FIG. 9.

The valve units 22 of the present embodiment each include the unit main body 56. The unit main body 56 includes two inlets 26*a* and 26*b* on one surface in the Y direction, with their positions offset in the Z direction. One end of the inlet 26 is connected to the other end of each ink supply tube 17 connected to each ink cartridge 13. As described above, two flow out portions 27*a* and 27*b* in which the liquid introducing needles 25 provided in the mount area 24 of the liquid introducing member 21 are disposed, with their positions offset in the Y direction. In other words, the flow out portions 27*a* and 27*b* of the valve unit 22 connect to a set of liquid introducing needles 25 arranged in the Y direction in the mount area 24.

The unit main body 56 includes two ink supply channels, that is, a first supply channel extending from the first inlet 26*a* to the first outlet 27*a* and a second supply channel extending from the second inlet 26*b* to the second outlet 27*b*. These supply channels constitute independent channels and include pressure regulation valves 57*a* and 57*b*, respectively. In other words, one valve unit 22 includes two pressure regulation valves 57*a* and 57*b*. These pressure regulation valves 57*a* and 57*b* are disposed at different positions of the unit main body 56 in the Y direction and at the same position in the Z direction. It is only required that at least part of the pressure regulation valve 57*a* and at least part of the pressure regulation valve 57*b* overlap as viewed from at least one direction on the X-Y plane, and their communication ports 60 may overlap with each other when the pressure regulation valves 57*a* and 57*b* are aligned in the Z direction. Therefore, the intervals from the nozzle plate 40 to the pressure regulation valves 57*a* and 57*b*, more specifically, the intervals from the nozzle plate 40 to the pressure regulation valves 57*a* and 57*b* of the valve units 22, are set equal, with the valve unit 22 mounted in the mount area 24 of the liquid introducing member 21 (in other words, in a state in which the liquid introducing needles 25 disposed in the mount area 24 are inserted in the flow out portions 27*a* and 27*b*). In other words, the water head relative to the nozzle plate 40 is made flush by the pressure regulation valves 57*a* and 57*b*. This allows the supply pressures of the ink supplied downstream from the pressure regulation valves 57*a* and 57*b*, that is, to the nozzles 47, to be made equal, suppressing variations in the ejection characteristics of the nozzles 47 of the nozzle row 48.

The unit main body 56 includes, on both sides, first and second valve chambers 58*a* and 58*b* (in other words, upstream liquid chambers) that respectively house the pressure regulation valves 57*a* and 57*b*, with their positions offset in the Y direction. Specifically, the first valve chamber 58*a* that houses the pressure regulation valve 57*a* corresponding to the first supply channel extending from the first inlet 26*a* to the first flow out portion 27*a* is disposed at the right side of the unit main body 56 in the present embodiment, with the position offset to the inlet 26 in the Y direction. The second valve chamber 58*b* that houses the pressure regulation valve 57*b* corresponding to the second supply channel extending from the second inlet 26*b* to the second flow out portions 27*b* is disposed at the left side of the unit main body 56 in the present embodiment, with the position offset to the opposite side from the inlet 26 in the Y direction. These first and second valve chambers 58*a* and 58*b* are recessed portion of the unit main body 56 recessed from one side to the opposite side to form a substantially circular opening. The unit main body 56 includes pressure regulation chambers 59*a* and 59*b* (a kind of downstream liquid chamber in the present disclosure) at sides opposite from the first and second valve chambers 58*a* and 58*b*, respectively. These pressure regulation chambers 59*a* and 59*b* are recessed portions each having a substantially circular opening having an opening area larger than the opening areas of the first and second valve chambers 58*a* and 58*b* and communicate with the corresponding valve chambers 58*a* and 58*b* through communication ports 60.

The unit main body 56 includes, on both sides, flexible films 65 made of synthetic resin, such as a polyphenylene sulfide film or a polyimide film, joined by thermal fusion or with an adhesive. Thus, the channels, such as the pressure regulation chambers 59*a* and 59*b* and the first and second valve chambers 58*a* and 58*b*, that are open to the both sides of the unit main body 56 are closed by the flexible films 65.

A portion of the flexible film 65 closing the opening of the pressure regulation chamber 59 to define part of the pressure regulation chamber 59 (in other words, a portion that is displaced according to the pressure change of the pressure regulation chamber 59) and a pressure receiving plate 67 (described below) function as a downstream cover member 69. Similarly, a portion of the flexible film 65 closing the opening of the valve chamber 58 to define part of the valve chamber 58 functions as an upstream cover member 70.

The ink introduced through the upper first inlet 26*a* of the two inlets 26*a* and 26*b* flows into the first valve chamber 58*a* through a first communication channel 61 formed at the right side of the unit main body 56. When the pressure regulation valve 57*a* opens the communication port 60 (described below), the ink flowing into the first valve chamber 58*a* flows into the pressure regulation chamber 59*a* through the communication port 60 and is fed out to the first flow out portion 27*a* through an outlet 63 communicating with the pressure regulation chamber 59*a*. Likewise, the ink flowing from the second inlet 26*b* downstream in the Z direction flows into the second valve chamber 58*b* through a second communication channel 62*a* formed on the right side of the unit main body 56 and a second communication channel 62*b* that communicates with the second communication channel 62*a* through a communication hole 64 and formed on the left side of the unit main body 56. When a pressure regulation valve 57*b* (described below) opens the communication port 60, the ink flows into the pressure regulation chamber 59*b* through the communication port 60 and is fed out to the flow out portion 27*b* through an outlet 63 that communicates with the pressure regulation chamber 59*b*.

As illustrated in FIG. 9, a spring bearing 72 is fitted in a position of the side of the unit main body 56 recessed toward the opposite side from the opening of the valve chamber 58 (58*a* and 58*b*) in such a manner as to close the valve chamber 58. The spring bearing 72 has a communication hole 75 in which the ink can communicate. There is a space between the flexible film 65 closing the valve chamber 58 and the spring bearing 72. A filter 73 is provided in the space so as to close the opening of the valve chamber 58. The filter 73 filters the ink flowing from the inlet 26 to the valve chamber 58.

The first and second valve chambers 58*a* and 58*b* house the pressure regulation valves 57*a* and 57*b* (a kind of valve element in the present disclosure), respectively. The pressure regulation valve 57 has a shaft 54 inserted to the communication port 60. The end of the shaft 54 projects into the pressure regulation chamber 59. The pressure regulation valve 57 includes, in the valve chamber 58, a disc-shaped sealing portion 55 having an area larger than the opening area of the communication port 60. The sealing portion 55 is a portion that opens and closes the communication port 60 by moving back and forth with respect to the periphery of the opening of the communication port 60. A ring-shaped protruding elastic member is provided at a surface of the sealing portion 55 facing the periphery of the opening of the communication port 60 in correspondence with the periphery of the opening of the communication port 60. The elastic member is brought into contact with the periphery of the opening of the communication port 60 to seal the communication port 60. The back of the sealing portion 55, that is, the surface facing the filter 73 is connected to one end of a valve urging member 74. The other end of the valve urging member 74 is connected to the spring bearing 72. The valve urging member 74 urges the pressure regulation valve 57 toward the valve closing side, that is, toward the pressure regulation chamber 59.

In the pressure regulation chamber 59, a cylindrical protrusion 76 protrudes from the periphery of the opening of the communication port 60. A disk-shaped pressure receiving plate 67 is provided at the end of the shaft 54 projecting into the pressure regulation chamber 59, with a pressure receiving plate urging member 66 formed of a spring or the like therebetween. The pressure receiving plate urging member 66 is mounted to the top face of the protrusion 76 and urges the pressure receiving plate 67 and the flexible film 65 constituting the downstream cover member 69 to the outside of the pressure regulation chamber 59. For this reason, the downstream cover member 69 bulges outside the opening of the pressure regulation chamber 59 in the unit main body 56 when the pressure regulation valve 57 closes the communication port 60 so that the pressure regulation chamber 59 is sufficiently filled with ink. In other words, a portion of the flexible film 65 corresponding to the pressure receiving plate 67 is positioned outside the position where the flexible film 65 and the unit main body 56 are welded (to the opposite side from the valve chamber 58). In this state, the pressure receiving plate 67 is not in contact with the end of the shaft 54 of the pressure regulation valve 57, so that a predetermined space is formed therebetween.

In the above configuration, the inlet 26 (26*a* and 26*b*) of the valve unit 22 is supplied with ink from the ink cartridge 13 through the ink supply tube 17. In a non-recording mode in which the liquid ejecting head 10 is not ejecting ink through the nozzles 47, that is, no ink is consumed, the urging force of the valve urging member 74 acts on the sealing portion 55 of the pressure regulation valve 57. The sealing portion 55 is under the pressure of the ink supplied to the valve chamber 58 through the inlet 26. This causes the sealing portion 55 of the pressure regulation valve 57 to come into contact with the opening periphery of the communication port 60 to close the communication port 60 into a valve closing state.

In contrast, when the liquid ejecting head 10 is in a recording mode, that is, in a state in which ink is ejected from the nozzles 47 so that the ink is consumed, the pressure in the pressure regulation chamber 59 decreases with the decrease of the ink in the pressure regulation chamber 59. This displaces the flexible film 65 serving as the downstream cover member 69 toward the valve chamber 58 (in other words, toward the bottom of the pressure regulation chamber 59) with the pressure receiving plate 67. When the flexible film 65 is displaced toward the valve chamber 58 for some distance, more specifically, by a distance corresponding to the interval between the pressure receiving plate 67 and the end of the shaft 54 of the pressure regulation valve 57, the pressure receiving plate 67 comes into contact with the end of the shaft 54 of the pressure regulation valve 57. When the pressure in the pressure regulation chamber 59 decreases from the pressure in that state, and the negative pressure exceeds the sum of the reaction forces of the pressure receiving plate urging member 66, the valve urging member 74, the ink supply pressure, and the displacement of the flexible film 65 (hereinafter referred to as "valve closing force as appropriate), the pressure receiving plate 67 pushes the shaft 54 against the valve closing force to displace the pressure regulation valve 57 toward the valve chamber 58. This releases the contact to the periphery of the communication port 60 with the sealing portion 55, bringing the pressure regulation valve 57 from the valve closed state to the valve open state.

When the pressure regulation valve is brought to the valve open state, the ink in the valve chamber 58 is supplied to the pressure regulation chamber 59 through the communication port 60, increasing the pressure in the pressure regulation chamber 59. This causes the pressure regulation valve 57 to move in the closing direction (that is, toward the pressure regulation chamber 59) by the valve closing force into the valve closed state again. As a result, the ink supply from the valve chamber 58 to the pressure regulation chamber 59 is stopped. In the above configuration, setting the area of the downstream cover member 69, that is, the pressure area of a portion that is displaced according to the pressure change of the pressure regulation chamber 59, to be larger than the area of the upstream cover member 70 increases the accuracy of the opening and closing operation of the pressure regulation valve 57 according to the pressure change of the pressure regulation chamber 59. In other words, the larger the pressure area, the smaller the influence of manufacturing errors of the shape, thickness, and so on of the unit main body 56 and the flexible film 65 is, further stabilizing the opening and closing operation of the pressure regulation valve 57.

A total of five valve units 22 are arranged in the X direction in the mount area 24 of the liquid introducing member 21 in the present embodiment. As illustrated in FIG. 2, the holder 23 is mounted, with the valve units 22 housed in a housing space 53. The holder 23 is a box-shaped member whose bottom is open and includes four side walls 78 surrounding the mount area 24 and a ceiling surface 79 disposed at the top of the side walls 78. The ceiling surface 79 has insertion holes 80 through which the ink supply tubes 17 connected to the inlets 26 of the valve units 22 disposed in the housing space 53 at the positions corresponding to the individual valve units 22. The ink supply tubes 17 are inserted into the insertion holes 80 and are connected to the inlets 26 of the corresponding valve units 22.

The liquid ejecting head 10 of the present disclosure is reduced in size while equalizing the ejection characteristics of the nozzles 47. In the present embodiment, as illustrated in FIG. 3, in arranging the liquid introducing needles 25 in the mount area 24 of the valve units 22, the interval P1 between two liquid introducing needles 25 adjacent in the Y direction (that is, the center-to-center distance) is set larger than the interval P2 between two liquid introducing needles 25 adjacent in the X direction. Accordingly, the interval in the X direction between the valve units 22 mounted in the mount area 24, that is, the center-to-center distance between the flow out portions 27 of adjacent valve units 22, is set to P2, and the center-to-center distance between the flow out portions 27*a* and 27*b* adjacent in the Y direction on the lower surfaces of the valve units 22 is set to P1.

Therefore, as illustrated in FIG. 9, the adjacent valve units 22 are disposed as close as possible to each other within a range in which the valve units 22 do not come into contact with the opposing valve unit 22 when the downstream cover member 69 bulges to the outermost side. In the present embodiment, in a first valve unit 22-1 of the valve units 22 arranged in the X direction, a downstream cover member 69*b* disposed at a surface adjacent to a second valve unit 22-2 (the right side surface in the present embodiment) faces an upstream cover member 70*b* of the second valve unit 22-2, and in the second valve unit 22-2, a downstream cover member 69*a* disposed at a surface adjacent to the first valve unit 22-1 (the left side surface in the present embodiment) faces an upstream cover member 70*a* of the first valve unit 22-1. In other words, the upstream cover member 70*b* of the second valve unit 22-2 is disposed at a position overlapping the downstream cover member 69*b* of the first valve unit 22-1 as viewed from the X direction. The downstream cover member 69*b* and the upstream cover member 70*b* do not come into contact with each other even if they bulge to the maximum extent outside the unit main body 56 as viewed from the Y direction, forming a space G therebetween. Likewise, the upstream cover member 70*a* of the first valve unit 22-1 is disposed at a portion overlapping the downstream cover member 69*a* of the second valve unit 22-2 as viewed from the X direction, and the upstream cover member 70*a* and the downstream cover member 69*a* do not come into contact with each other even if they bulge to the maximum extent outside the unit main body 56, forming a space G, as viewed from the Y direction.

According to the configuration of the present embodiment, when the downstream cover member 69 of each valve unit 22 is displaced, the downstream cover member 69 does not come into contact with the upstream cover member 70 of the adjacent valve unit 22, allowing the pressure regulation valve 57 to perform an opening and closing operation according to the pressure change of the pressure regulation chamber 59 without a hindrance. The downstream cover member 69*b* of the first valve unit 22-1 adjacent to the second valve unit 22-2 and the downstream cover member 69*a* of the second valve unit 22-2 adjacent to the first valve unit 22-1 are disposed at different positions in the Y direction but are disposed at positions and intervals at which the downstream cover member 69*b* and the downstream cover member 69*a* overlap each other as viewed from the Y direction when bulging to the maximum extent outside the unit main body 56.

Since the adjacent valve units 22 are thus disposed as close as possible to each other within a range in which the downstream cover member 69 does not come into contact with the opposing valve unit 22 when bulging to the outermost side, no wall is provided between the valve units 22 in the holder 23. In other words, of the space G between the first valve unit 22-1 and the second valve unit 22-2, there is no wall at least in an area overlapping the downstream cover member 69 (69*a* and 69*b*) as viewed from the X direction. However, a portion that defines the arrangement of the valve units 22, for example, a rib with a thickness that has no influence on the space G (does not increase the space G) between the valve units 22 in an area overlapping the downstream cover member 69 as viewed from the X direction, may be present out of the area between the valve units 22 in the holder 23.

In the liquid ejecting head 10 according to the embodiment of the present disclosure, there is no wall between the valve units 22 adjacent in the X direction in the holder 23, and the valve units 22 are disposed as close as possible to each other, allowing the liquid ejecting head 10 to be reduced in size in the X direction. Since the scanning range of the liquid ejecting head 10 can be reduced by the amount corresponding to the size reduction of the liquid ejecting head 10 in the X direction, the entire liquid ejecting apparatus 1 including the liquid ejecting head 10 can be reduced in size in the X direction. Furthermore, the intervals from the nozzle plate 40 to the pressure regulation valves 57 in the individual valve units 22 are equalized, as described above, the supply pressures of ink downstream from the pressure regulation valves 57, that is, to the nozzles 47, are made equal among the valve units 22. This allows reducing variations in ejection characteristics among the nozzle rows 48. Furthermore, since the valve unit 22 includes two pressure regulation valves 57*a* and 57*b* arranged in the Y direction, and the corresponding downstream cover members 69*a* and 69*b* are arranged at separate positions in the Y direction, large pressure areas can be provided. This improves the accuracy of the opening and closing operation of the pressure regulation valve 57 according to the pressure change of the pressure regulation chamber 59, as described above. Furthermore, in the present embodiment, the downstream cover members 69*a* and 69*b* are disposed at opposite surfaces in the X direction, and the intervals from the nozzle plate 40 to the individual pressure regulation valves 57*a* and 57*b* of the valve units 22 are equalized. This allows equalizing the ink supply pressures downstream from the pressure regulation valves 57*a* and 57*b*, thereby reducing variations in the ejection characteristics of the nozzles 47 of the nozzle row 48.

Although the above embodiment illustrates a configuration in which the liquid ejecting head 10 ejects ink while scanning along the width of the medium, this is given for mere illustrative purposes and is not intended to limit the present disclosure. The present disclosure can also be applied to a what-is-called line liquid ejecting head including a unit head group in which a plurality of unit heads are arranged in a direction intersecting the medium transporting direction, in which the entire length of the nozzle group including multiple unit heads corresponds to the maximum recording width of the medium, and in which scanning along the width of the medium is not performed. Although, in the above embodiment, two inlet channels 33 are disposed in the common liquid chamber 43, only one inlet channels 33 may be disposed, or three or more inlet channels 33 may be disposed. Although, in the above embodiment, the valve unit 22 is mounted to the liquid introducing needle 25, the liquid storage may be mounted.

The present disclosure may also be applied to a liquid ejecting head that employs a configuration including multiple valve units and to a liquid ejecting apparatus including the liquid ejecting head. The present disclosure may also be applied to a liquid ejecting head including a plurality of color-material ejecting heads for use in manufacturing color filters of liquid displays or the like, electrode-material ejecting heads for use in forming organic electro luminescence (EL) displays, field emission displays (FEDs), or the like, and bioorganic-substance ejecting heads for use in manufacturing biochips, and to a liquid ejecting apparatus including the same.

What is claimed is:

1. A liquid ejecting head comprising:

valve mechanisms including a first-valve mechanism and a second-valve mechanism;

a nozzle plate including nozzles ejecting liquid supplied from any one of the valve mechanisms; and a holder housing the valve mechanisms, wherein the nozzle plate extends in a second direction and a third direction, the second direction and the third direction being orthogonal to each other and being orthogonal to a first direction being perpendicular to the nozzle plate, the first-valve mechanism includes a first-valve element, a first-downstream chamber downstream of the first-valve element, and a first-downstream cover member defining a part of the first-downstream chamber and being displaced based on a pressure in the first-downstream chamber, the first-valve mechanism opens/closes a channel by moving the first-valve element based on the pressure in the first-downstream chamber, the second-valve mechanism includes a second-valve element, a second-downstream chamber downstream of the second-valve element, and a second-downstream cover member defining a part of the second-downstream chamber and being displaced based on a pressure in the second-downstream chamber, the second-valve mechanism opens/closes a channel by moving the second-valve element based on the pressure in the second-downstream chamber, the first-valve mechanism and the second-valve mechanism arranged in the third direction with a space between the first-valve mechanism and the second-valve mechanism, the first-downstream cover member and the second-downstream cover member are disposed so as to face each other, an interval between the nozzle plate and the first-valve element and an interval between the nozzle plate and the second-valve element are equal to each other in the first direction, and the holder has no wall in an area of the space between the first-valve mechanism and the second-valve mechanism, the area overlapping the first-downstream cover member and the second-downstream cover member as viewed from the third direction.

2. The liquid ejecting head according to claim 1, further comprising:

sets of liquid introducing portions arranged in the third direction, the liquid introducing portions being arranged in the second direction to constitute the set of liquid introducing portions, the liquid introducing portions respectively introducing liquid from each of the valve mechanisms, wherein the nozzles are arranged in the second direction to constitute a nozzle row, an interval between the liquid introducing portions adjacent in the second direction is larger than an interval between the liquid introducing portions adjacent in the third direction.

3. The liquid ejecting head according to claim 2, wherein a number of the liquid introducing portions constituting the set of liquid introducing portions is smaller than a number of the sets of liquid introducing portions arranged in the third direction, and the interval between the liquid introducing portions adjacent in the second direction is larger the interval between the liquid introducing portions adjacent in the third direction.

4. A liquid ejecting apparatus comprising the liquid ejecting head according to claim 1.

5. The liquid ejecting head according to claim 1, wherein a part of the first-downstream cover member and a part of the second-downstream cover member overlap when viewed from the second direction.

6. A liquid ejecting head comprising:

valve mechanisms including a first-valve mechanism and a second-valve mechanism; and a nozzle plate including nozzles ejecting liquid supplied from any one of the valve mechanisms, wherein the nozzle plate extends in a second direction and a third direction, the second direction and the third direction being orthogonal to each other and being orthogonal to a first direction being perpendicular to the nozzle plate, the first-valve mechanism includes a first-valve element, a first-downstream chamber downstream of the first-valve element, and a first-downstream cover member defining a part of the first-downstream chamber and being displaced based on a pressure in the first-downstream chamber, the first-valve mechanism opens/closes a channel by moving the first-valve element based on the pressure in the first-downstream chamber, the second-valve mechanism includes a second-valve element, a second-downstream chamber downstream of the second-valve element, and a second-downstream cover member defining a part of the second-downstream chamber and being displaced based on a pressure in the second-downstream chamber, the second-valve mechanism opens/closes a channel by moving the second-valve element based on the pressure in the second-downstream chamber, the first-valve mechanism and the second-valve mechanism arranged in the third direction with a space between the first-valve mechanism and the second-valve mechanism, the first-downstream cover member and the second-downstream cover member are disposed so as to face each other, an interval between the nozzle plate and the first-valve element and an interval between the nozzle plate and the second-valve element are equal to each other in the first direction, the first-downstream cover member and the second-downstream cover member are disposed at different positions with respect to the third direction, and a part of the first-downstream cover member and a part of the second-downstream cover member overlap as viewed from the second direction.

7. The liquid ejecting head according to claim 6, further comprising:

sets of liquid introducing portions arranged in the third direction, the liquid introducing portions being arranged in the second direction to constitute the set of liquid introducing portions, the liquid introducing portions respectively introducing liquid from each of the valve mechanisms, wherein the nozzles are arranged in the second direction to constitute a nozzle row, an interval between the liquid introducing portions adjacent in the second direction is larger than an interval between the liquid introducing portions adjacent in the third direction.

8. The liquid ejecting head according to claim 7, wherein a number of the liquid introducing portions constituting the set of liquid introducing portions is smaller than a number of the sets of liquid introducing portions arranged in the third direction, and the interval between the liquid introducing portions adjacent in the second direction is larger the interval between the liquid introducing portions adjacent in the third direction.

9. The liquid ejecting head according to claim 6, further comprising:

a holder housing the valve mechanisms, wherein the holder has no wall in an area of the space between the first-valve mechanism and the second-valve mechanism, the area overlapping the first-downstream cover member and the second-valve mechanism as viewed from the third direction.

10. A liquid ejecting apparatus comprising the liquid ejecting head according to claim 6.

11. A liquid ejecting head comprising:

a nozzle plate including nozzles ejecting liquid;

liquid introducing portions configured to introduce liquid into the nozzles, valve mechanisms each including a valve element, the valve mechanisms each opening and closing a channel by moving the valve element based on a pressure in a channel downstream of the valve element to control supply of liquid to the liquid introducing portion, wherein:

the nozzles are arranged in a second direction orthogonal to a first direction perpendicular to the nozzle plate to constitute nozzle rows, the nozzle row being constituted by arranging a part of the nozzles in the second direction, the nozzle rows are arranged in a third direction orthogonal to the first direction and the second direction, sets of the liquid introducing portions arranged in the third direction, the introducing portions being arranged in the second direction to constitute one of the sets of the liquid ejecting potions, and an interval between the liquid introducing portions adjacent in the second direction is larger than an interval between the liquid introducing portions adjacent in the third direction.

12. The liquid ejecting head according to claim 11, wherein the valve mechanisms are individually coupled to the sets of liquid introducing portions and arranged in the third direction, the valve mechanisms include a first-valve mechanism and a second-valve mechanism, and an interval between the nozzle plate and the valve element of the first-valve mechanism and an interval between the nozzle plate and the valve element of the second-valve mechanism are equal to each other in the first direction.

13. The liquid ejecting head according to claim 12, wherein a number of the liquid introducing portions constituting the set of liquid introducing portions is smaller than a number of the sets of liquid introducing portions arranged in the third direction, and the interval between the liquid introducing portions adjacent in the second direction is larger the interval between the liquid introducing portions adjacent in the third direction.

14. The liquid ejecting head according to claim 11, wherein a number of the liquid introducing portions constituting the set of liquid introducing portions is smaller than a number of the sets of liquid introducing portions arranged in the third direction, and the interval between the liquid introducing portions adjacent in the second direction is larger the interval between the liquid introducing portions adjacent in the third direction.

15. A liquid ejecting apparatus comprising the liquid ejecting head according to claim 11.

16. The liquid ejecting head according to claim 11, wherein each of the valve mechanisms includes a downstream cover member, and at least two adjacent valve mechanisms overlap when viewed in the second direction.

17. The liquid ejecting head according to claim 11, wherein each of the valve mechanisms includes inlets for connecting to flow paths outside of the liquid ejecting head, and a direction flowing liquid in the inlet intersects a direction flowing liquid in the liquid introducing portion.

* * * * *